United States Patent [19]

Katz

[11] Patent Number: 4,865,312

[45] Date of Patent: Sep. 12, 1989

[54] RECREATIONAL DEVICE FOR PHYSICALLY DISABLED CHILDREN

[76] Inventor: Richard Katz, 711 Clarence Ave., Oak Park, Ill. 60304

[21] Appl. No.: 229,436

[22] Filed: Aug. 8, 1988

[51] Int. Cl.[4] ..... A63G 21/04

[52] U.S. Cl. ..... 272/56.5 R; 182/48

[58] Field of Search ..... 272/56.5 R, 56.5 S, 272/70, 117; 182/48, 49, 113, 152, 93; 14/69.5, 71.7

[56] References Cited

U.S. PATENT DOCUMENTS

| | | | |
|---|---|---|---|
| 3,743,281 | 7/1973 | Gimbel | 272/56.5 R |
| 3,796,429 | 3/1974 | Johnston | 272/56.5 R |
| 4,153,244 | 5/1979 | Tauber, Jr. | 272/117 |
| 4,418,792 | 12/1983 | Cerone | 182/93 |
| 4,630,709 | 12/1986 | Taylor | 182/48 |

*Primary Examiner*—John E. Murtagh
*Assistant Examiner*—Richard E. Chilcot, Jr.
*Attorney, Agent, or Firm*—Wood, Dalton, Phillips, Mason & Rowe

[57] ABSTRACT

A recreational device for physically disabled persons is provided and consists of a slide with a low friction inclined bed surface having a top and bottom; a first wheelchair transfer station adjacent the top of the slide bed surface with a first surface for supporting a wheelchair, a substantially flat, horizontally situated entry platform at the top of the slide bed surface, elevated above the first wheelchair supporting surface and having an upwardly facing surface that blends into the slide bed surface; a second wheelchair transfer station adjacent the bottom of the slide surface with a second surface for supporting a wheelchair, a substantially flat, horizontally situated landing platform at the bottom of the bed surface, elevated above the second wheelchair supporting surface, and having an upwardly facing surface that blends into the slide bed surface; and an inclined ramp to permit a user to propel a wheelchair from the second wheelchair supporting surface to the first wheelchair supporting surface.

20 Claims, 7 Drawing Sheets

RECREATIONAL DEVICE FOR PHYSICALLY DISABLED CHILDREN

BACKGROUND OF THE INVENTION

1. Field of the Invention

This invention relates to recreational slides and, more particularly, to a slide that can be utilized by an individual with a lower body disability.

2. Background Art

In recent years, there has been an increasing awareness of the needs of physically handicapped persons, particularly those in their younger years. Whereas, it was at one time accepted for there to be segregation of able-bodied and disabled children in schools, it is now common for this distinction to be ignored. Schools designated "special" have been established to permit physically disabled and able-bodied children to coexist in an environment that is beneficial to both groups. Disabled children experience an environment that is similar to that which they will experience outside of school. Able-bodied children are given a chance to mingle with the physically disabled and become familiar with and understand various disabilities and the associated problems with which the disabled must contend.

One problem that the special schools have encountered is that the physical plants frequently are not adapted to accommodate the disabled child. This is particularly true with schools' outdoor recreational facilities. Most playground equipment is made for the able-bodied child and, in spite of the desire of the disabled children to participate in playground activities, they are generally relegated to the role of spectators. This not only proves frustrating to the handicapped children but impedes their physical development and deprives them of the psychological lift that results from physical challenge and achievement.

SUMMARY OF THE INVENTION

According to the present invention, a recreational device for physically disabled persons is provided and consists of a slide with a low friction inclined bed surface having a top and bottom; a first wheelchair transfer station adjacent the top of the slide bed surface with a first surface for supporting a wheelchair, a substantially flat, horizontally situated entry platform at the top of the slide bed surface, elevated above the first wheelchair supporting surface and having an upwardly facing surface that blends into the slide bed surface; a second wheelchair transfer station adjacent the bottom of the slide bed surface with a second surface for supporting a wheelchair, a substantially flat, horizontally situated landing platform at the bottom of the bed surface, elevated above the second wheelchair supporting surface, and having an upwardly facing surface that blends into the slide bed surface; and an inclined ramp to permit a user to propel a wheelchair from the second wheelchair supporting surface to the first wheelchair supporting surface.

With the inventive structure, a user in a wheelchair can propel the wheelchair up the inclined ramp to the first transfer station, make a parallel transfer to the entry platform, travel down the slide bed surface and make a parallel transfer between the landing platform and a wheelchair at the second wheelchair transfer station, after which the activity can be repeated. With the inventive structure, the disabled child is afforded a safe, fun, challenging and meaningful experience. At the same time, the described structure can be used easily by the able-bodied so that there is integrated play between disabled and able-bodied children.

A further objective of the invention is to develop the upper body strength of children having lower body disabilities. Those afflicted with cerebral palsy, spina bifida, lower body paralysis and similar disabilities may have fully-functional upper bodies. To afford both exercise and a challenge to disabled persons with functional upper bodies, a second slide is provided in side-by-side relationship with the first slide. Structure is provided to assist the user in drawing himself up the second slide to the entry platform so that he can slide back down the first slide.

In one embodiment, a plurality of rigid uprights are provided in spaced relationship between the top and bottom of the second slide. These uprights can be provided on one side or in spaced relationship at both sides of the second slide. The user grabs one or a pair of the uprights and draws himself upwardly sufficiently to grasp a higher upright and keeps repeating this procedure until elevating himself to the entry platform.

Alternatively, one or more hand rails can be provided on the second slide. As an alternative to the plural fixed uprights and hand rails, a flexible line having its ends attached at the entry and landing platforms above the slide bed surface can be employed. A line can be provided at one or both sides of the second slide. A plurality of hand holds are afforded on the line(s) to be grasped successively by a user in drawing himself upwardly in the same manner as with the previously described uprights. The hand holds may be defined by loops in the line, which may be nylon or other suitable material. Structure may be provided to removably attach the line(s) so that the device can be selectively used with and without the lines.

A further aspect of the invention is the provision of structure to selectively mount the line at different heights above the slide bed surface, depending upon the size of the disabled person.

To afford assistance to a user on the second slide, a flight of stairs is located adjacent to the second slide so that a supervisor can climb up and remain alongside of the user moving up the second slide. The supervisor may intervene when appropriate to assist the user. At the same time, the stairs can be used by the able-bodied moving up to the entry platform.

A second stairway can be provided adjacent to the first slide to assist users of the first slide. The additional stairway makes it possible for the able-bodied to use a separate set of stairs so as not to interfere with those supervising children on the second slide.

Another aspect of the invention is the provision of a bar extending across both the first and second slides above the entry platform adjacent the juncture of the entry platform and the slide bed surfaces. This bar assists a disabled person in elevating himself from the second slide and also assists alignment of children sliding down the first slide.

To facilitate propulsion of wheelchairs up the inclined ramp, the ramp has at least two inclined sections with an intermediate rest platform. Preferably, there are a plurality of rest platforms each having an inclined ramp section leading up thereto. To compact the overall design of the device, the inclined ramp, when viewed in plan, is curved or L-shaped.

DETAILED DESCRIPTION OF THE DRAWINGS

Figure 1:
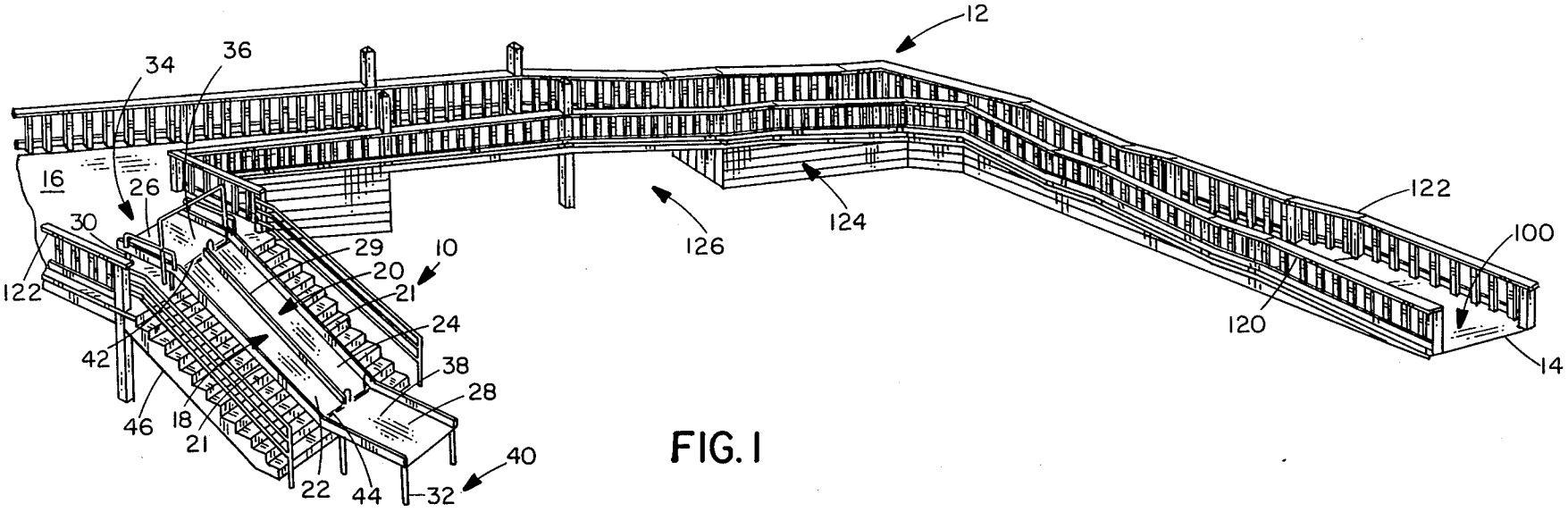
FIG. 1 is a perspective view of a recreational device consisting of a slide assembly with an associated wheelchair ramp for physically disabled persons, according to the present invention.
Figure 2:
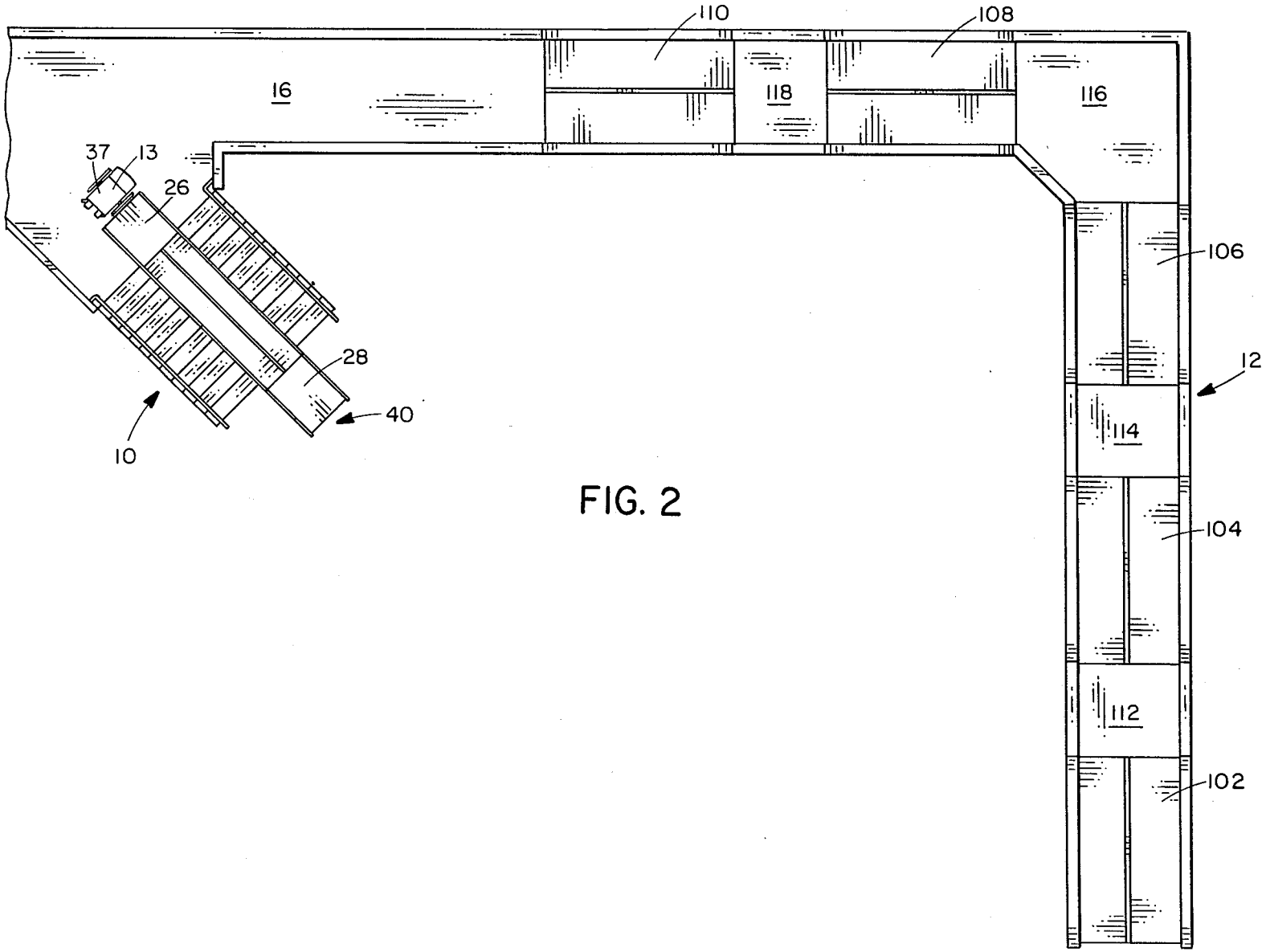
FIG. 2 is a plan view of the recreational device in FIG. 1.
Figure 3:
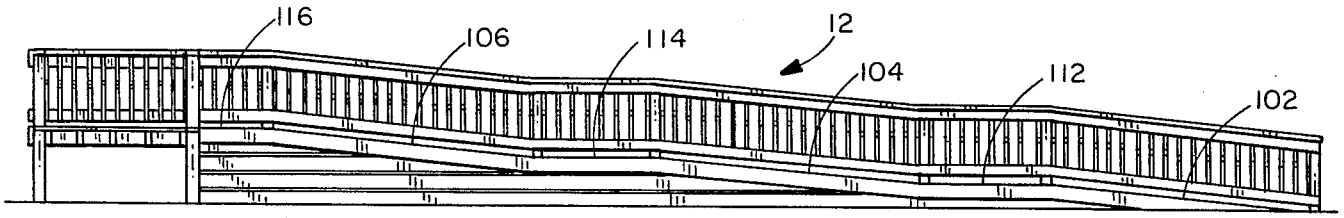
FIG. 3 is a left side elevation view of the wheelchair ramp.
Figure 4:
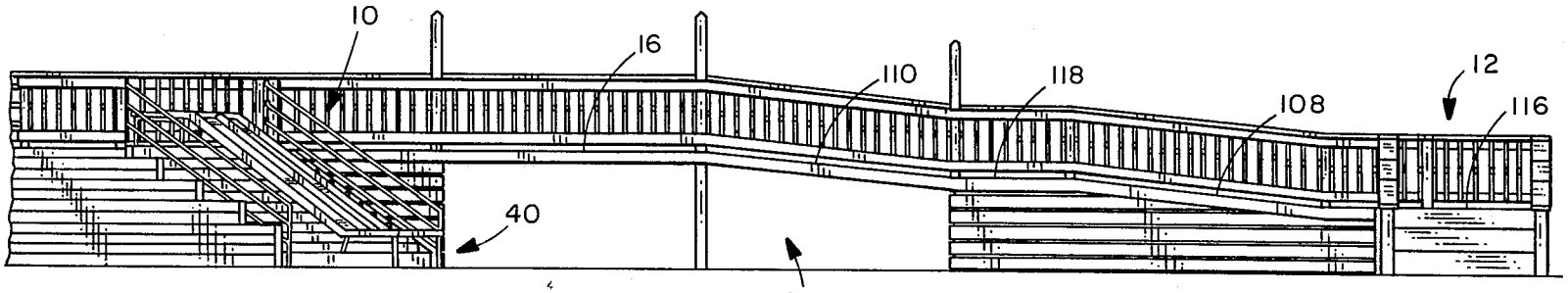
FIG. 4 is a front elevation view of the recreational device.
Figure 5:
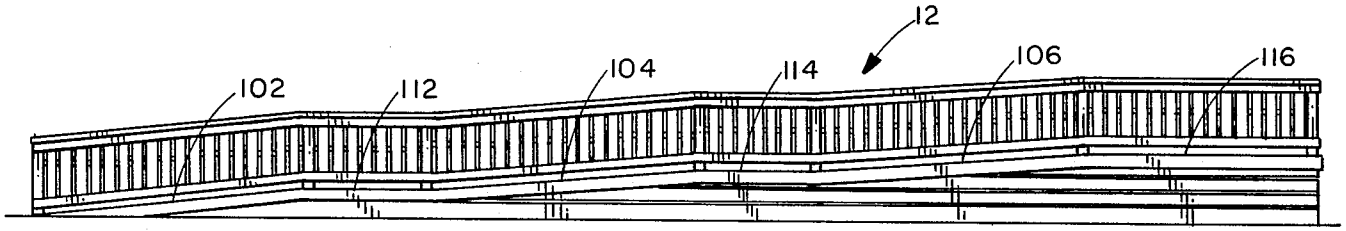
FIG. 5 is a right side elevation view of the wheelchair ramp.
Figure 6:
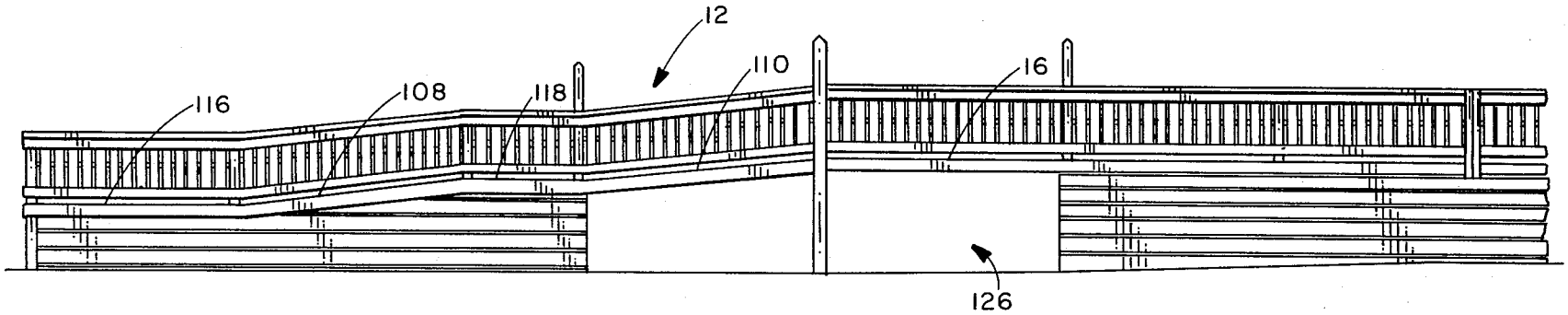
FIG. 6 is a rear elevation view of the recreational device.
Figure 8:
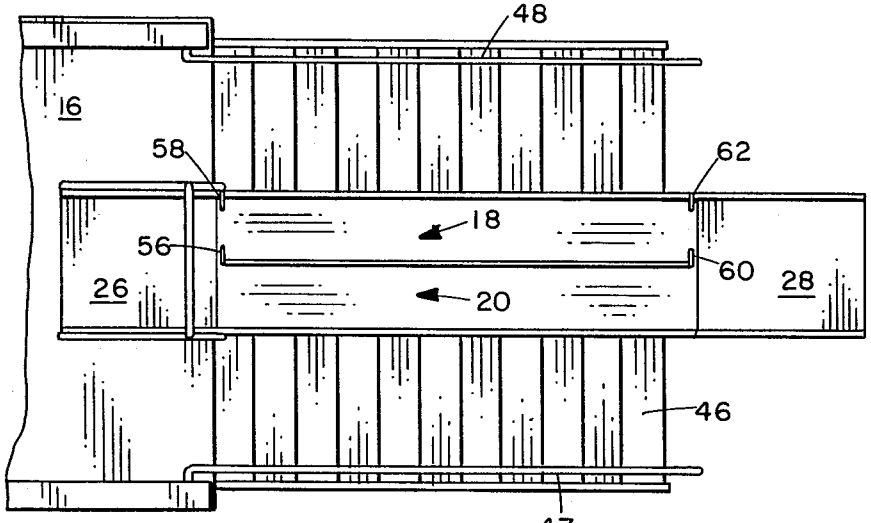
FIG. 8 is a plan view of the slide assembly.
Figure 7:
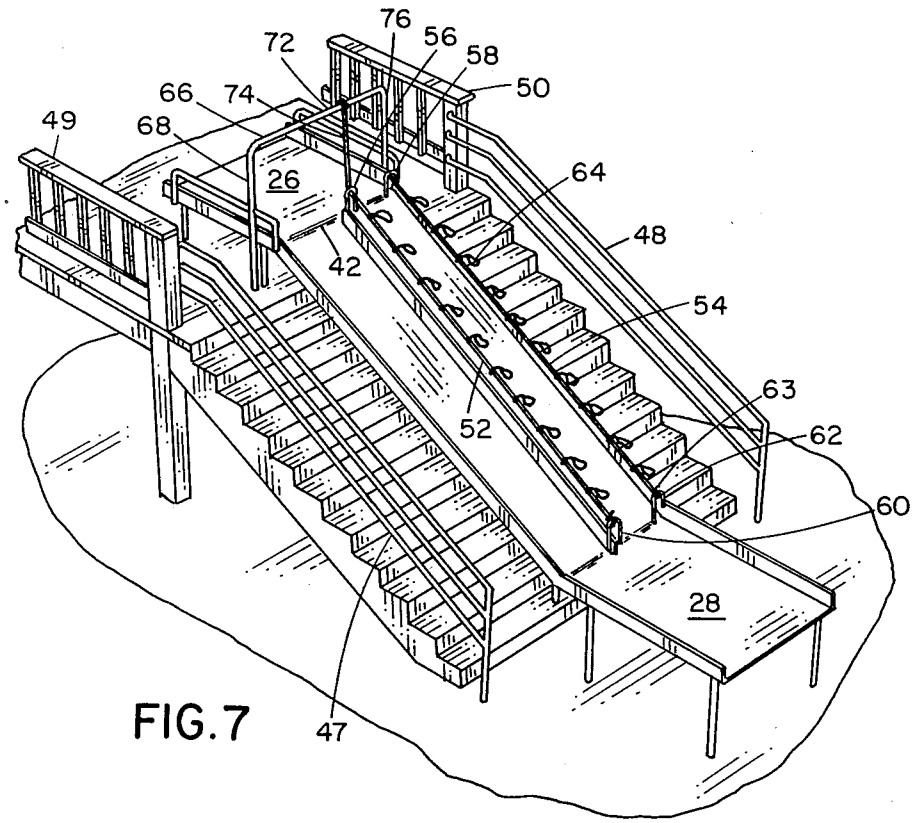
FIG. 7 is a perspective view of the slide assembly.
Figure 10:
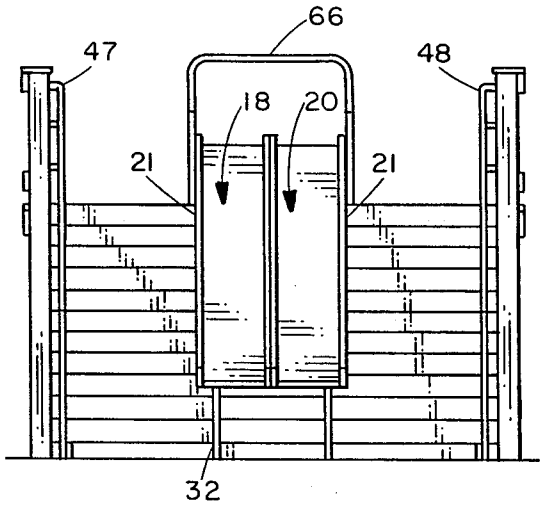
FIG. 10 is a front elevation view of the slide assembly.
Figure 9:
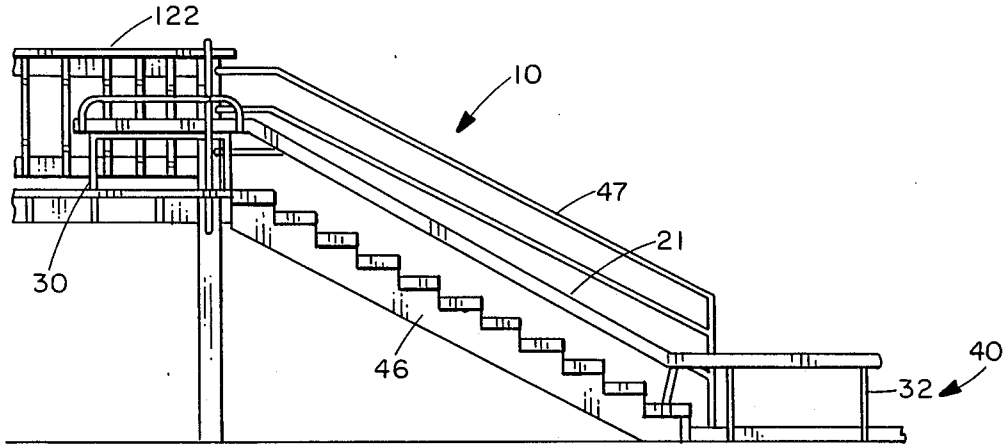
FIG. 9 is a side elevation view of the slide assembly.

As seen clearly in FIGS. 1–6, the recreational device, according to the present invention, consists of a slide assembly at 10 with an L-shaped inclined ramp at 12 along which a wheelchair 13 can be propelled to progressively effect elevation thereof from ground level at the base 14 of the ramp 12 to a flat, elevated wheelchair supporting surface 16 at the upper end of the slide assembly 10.

The slide assembly 10 is shown clearly in FIGS. 1, 2, 4 and 7–11 and consists of first and second straight slides 18,20, respectively, in side-by-side relationship and laterally bounded by spaced upright side rails 21. The first slide 18 has a low friction inclined bed surface 22 which is coplanar with a bed surface 24 on the second slide 20. The bed surfaces 22, 24 are preferably defined by a single sheet of material which is bent over at the top of the slides 18, 20 to define an entry platform 26 and bent upwardly at he bottom of the slides 18, 20 to define a landing platform 28. A center rail 29 divides the first and second slides 18, 20. The entry platform 26 is supported on and above the surface 16 by a plurality of legs 30. The landing platform 28 is supported above the ground by a plurality of like legs 32.

To utilize the slide assembly 10, the disabled user propels a wheelchair up the inclined ramp 12 to the supporting surface 16 and maneuvers the wheelchair to a transfer station at 34 adjacent to the entry platform 26. The upwardly facing surface 36 of the entry platform 26 is set to be approximately at the height of the seat 37 on a conventional wheelchair 13. This facilitates a parallel transfer by the user off of the wheelchair 13 onto the platform 26. The user then slides down the first slide 18 and onto the landing platform 28 at the bottom thereof. The upwardly facing surface 38 of the landing platform 28 is spaced above the ground approximately the same distance that the entry platform 26 is spaced above supporting surface 16 so that the user can conveniently make a parallel transfer from the landing platform 28 to a wheelchair 13 situated at a second transfer station 40 at the forward portion of the platform 28.

The upwardly facing surface 36 of the platform 26 blends smoothly into the bed surfaces 22, 24 at the juncture 42 thereof and in turn the slide bed surfaces 22, 24 blend smoothly into the upwardly facing surface 38 at their juncture 44 to afford a smooth sliding path for the user between the platform 26, the first and second slides 18, 20 and the landing platform 28.

The invention contemplates several different ways of using the slide assembly 10. A user can travel from the platform 26 down either of the slides 18, 20 onto the landing platform 28. An able-bodied user can then walk up a flight of stairs 46 back up to the entry platform 26. The flight of stairs 46 has a rise equal to that of the first and second slides 18, 20, connects between the ground and the supporting surface 16 beneath the slides 18, 20, and extends laterally beyond both the first and second slides 18, 20. Upon climbing the stairs 46, the able-bodied user is in a position to move onto the platform 26. Guard rails 47, 48 are provided at the sides of the stairs 46 and extend into guard rails 49,50 on the supporting surface 16. The rails 47, 48, 49, 50 can be used to assist those climbing the stairs 46 and confine users to the stairs 46 and supporting surface 16.

As an alternative to using a wheelchair to move from the ground to the supporting surface 16, as previously described, a disabled user with a functional upper body can draw himself up the second slide 20 from the platform 28 to the entry platform 26 to again go down the first slide 18. Travel up the second slide 20 presents a challenge to the disabled user and affords exercise to the user's upper body muscles.

To facilitate movement of the user up the second slide 20, the user may face forwardly and by grasping and pulling against rails 21, 29 bounding the bed surface 24, draw himself up to the platform 26.

As an alternative to the use of the rails 21, 29 laterally spaced flexible lines 52, 54 can be utilized. To facilitate connection of the lines 52, 54 to the slide assembly 10, inverted U-bolts 56, 58 are fixedly attached to the platform 26 and U-bolts 60, 62 are similarly attached to the landing platform 28. The line 52 is removably secured at its ends as by S-clips 63 to the spaced U-bolts 56, 60 and the line 54 is similarly attached at its ends to the U-bolts 58, 62 so that the lines 52, 54 are substantially parallel and spaced equidistantly from the center line of the bed surface 24. A plurality of hand holds 64 are provided on each line 52, 54 to be grasped by the disabled user. The user grabs the hand holds 64 and pulls himself up until a higher hand hold 64 can be reached and repeats this procedure until arriving at the platform 26. In a preferred form, the lines 52, 54 are made of nylon rope and the hand holds are defined by knotting the line to define a graspable loop.

Another aspect of the invention is the provision of structure to alter the height of the lines 52, 54 above the bed surfaces 22, 24 to accommodate different size users. To facilitate this, an inverted U-shaped cross bar 66 is provided with legs 68, 70 extending upwardly from the surface 16 and an interconnecting base bar 72. The bar 72 spans the width of the first and second slides 18, 20 and is located above the juncture 42 of the platform 26 and slides 18, 20. A line or other suitable member 74 connects between the base bar 72 and the U-bolt 56. The upper end of line 52 can be secured anywhere along the length of the line 74 to vary the height thereof above the bed surfaces 22, 24. The line 54 can be similarly attached at a desired height on the cross bar leg 70. A similar cross bar (not shown) can be provided at the bottom of the slides 18, 20 to attach the bottom end of lines 52, 54 at the same height as the top ends thereof.

The cross bar 66 serves the additional function of facilitating entry onto the first slide 18 from the platform 26 and further can be grasped by a user on the second slide 20 to pull himself upwardly onto the entry platform 26.

Figure 11:
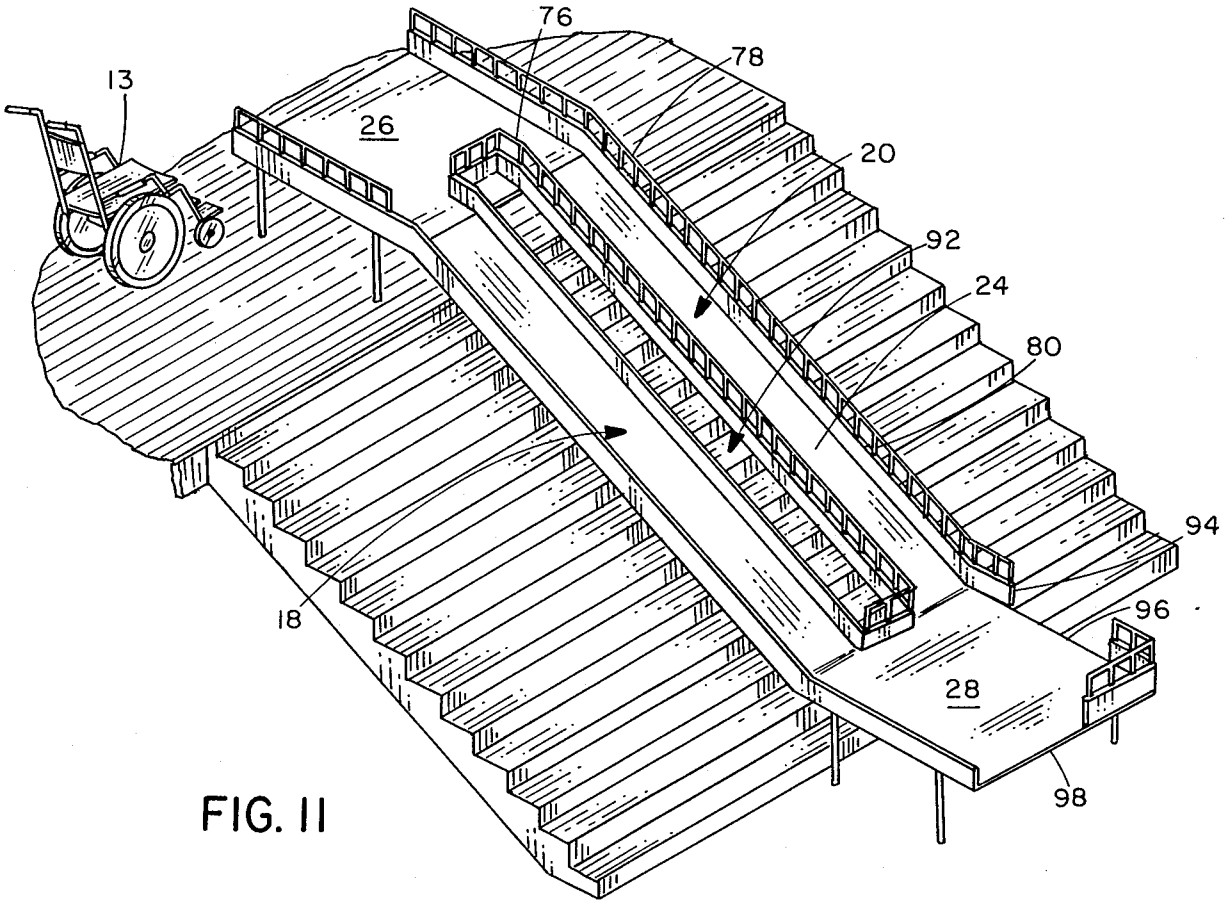
FIG. 11 is a perspective view of a modified form of slide assembly according to the invention.

FIG. 11 shows as an alternative to the use of lines 52, 54 In FIG. 11, fixed rails 76, 78 are supported above the bed surface 24 by a plurality of equidistantly spaced uprights 80. The user can progressively pull himself up the slide 20 by either grasping the uprights 80 or the rails 76, 78 at the juncture of the rails 76, 78 and uprights 80.

The stairs 46 at the sides of the first slide 18 and second slide 20 permit a supervisor to climb alongside of the user on each of the first and second slides 18, 20. The supervisor situated on the stairs 46 has ready access to both the first and second slides to, if necessary, assist a user thereof.

The modified device in FIG. 11 has two additional features that distinguish it from the embodiment in FIGS. 1–10. A space 92 is maintained between the first and second slides 18, 20, to prevent interference between users of the separate slides. This gives more maneuvering room to a user pulling himself up the second slide 20.

Another difference between the FIG. 11 embodiment and that in FIGS. 1–10 is that the slide assembly in FIG. 11 has a side opening 94 to permit parallel transfer from the landing platform 28 to a wheelchair situated at the side thereof adjacent the opening 94. The user thus has the option of making a parallel transfer to the wheelchair at the side 96 of the first ramp or at the front 98 of the platform 28.

To facilitate movement of a wheelchair up the ramp 12, the inclined surface 100 of the ramp 12 is built in steps. There are five ramp sections 102, 104, 106, 108, 110 clearly shown in FIG. 2. At the top of each ramp section 102, 104, 106, 108, 110 is a rest platform 112, 114, 116, 118, 16 respectively. The user can propel a wheelchair up the ramp section 102 to rest at platform 112 and stop there to regain his energy and then proceed in like fashion up the remainder of the ramp sections 104, 106, 108, 110. The precise number of rest platforms is a design choice. The ramp 12 is made in the shape of an L to afford a more compact structure. Guard rails 120, 122 are provided along the sides of the ramp surface 100 to confine movement of a wheelchair thereon.

Supporting structure at 124 for the ramp 12 is enclosed so as to be suitable for storage. The supporting structure 124 is interrupted at 126 to permit passage by individuals under the ramp 12.

I claim:

1. A recreational device for physically disabled persons, said recreational device comprising:

a slide with a low friction inclined bed surface having a top and bottom;

a first wheelchair transfer station adjacent the top of the slide bed surface with a first surface for supporting a wheelchair;

a substantially flat horizontally situated entry platform at the top of the slide bed surface and elevated above the first wheelchair supporting surface at the first wheelchair transfer station, said entry platform having an upwardly facing surface that blends into the slide bed surface to permit a user to slide along the platform onto the slide bed surface;

a second wheelchair transfer station adjacent the bottom of the slide bed surface with a second surface for supporting a wheelchair;

a substantially flat horizontally situated landing platform at the bottom of the bed surface and elevated above the second wheelchair supporting surface, said landing platform having an upwardly facing surface that blends into the slide bed surface to permit a user to slide from the bed surface onto the upwardly facing surface of the landing platform; and an inclined ramp to permit a user to propel a wheelchair from the second wheel chair supporting surface to the first wheelchair supporting surface, whereby a user in a wheelchair can propel the wheelchair up the inclined ramp to the first transfer station, make a parallel transfer to the entry platform, travel down the slide and make a parallel transfer between the landing platform and a wheelchair at the second wheelchair transfer station.

2. The recreational device for physically disabled persons according to claim 1 wherein there is a second slide with a top and bottom and an inclined bed having a surface that blends into the upwardly facing surfaces of both the entry and the landing platforms and means are provided to assist a user in progressively pulling himself back up the second slide.

3. The recreational device for physically disabled persons according to claim 2 wherein there is a flight of stairs adjacent to the second slide to permit a supervisor to climb alongside of a user on the second slide to assist the user in pulling himself up the second slide.

4. The recreational device for physically disabled persons according to claim 2 wherein there is a bar extending across the first and second slides above the slide bed surfaces adjacent the juncture of the slide bed surfaces and the upwardly facing surface of the entry platform both to assist the user in positioning himself at the top of the first claimed slide and to assist the user in pulling himself up off of the second slide bed surface onto the upwardly facing surface of the entry platform.

5. The recreational device for physically disabled persons according to claim 2 wherein said assist means comprises a line extending between the top and bottom of the second slide above the slide bed surfaces and a plurality of spaced hand holds on said line to be grasped by a user pulling himself up the second slide.

6. The recreational device for physically disabled persons according to claim 5 wherein means are provided to alter the height of the line above the slide bed surfaces.

7. The recreational device for physically disabled persons according to claim 1 wherein said inclined ramp has at least first and second inclined ramp sections and a substantially flat horizontal rest platform between the first and second ramp sections.

8. The recreational device for physically disabled persons according to claim 2 wherein said assist means comprises an elongate rail and means mounting the rail to the second slide so that the rail extends angularly upwardly from the bottom to the top of the second slide.

9. A recreational device for physically disabled persons, said recreational device comprising:

a first slide with a low friction inclined bed surface having a top and bottom;

a second slide with a low friction inclined bed surface having a top and bottom, said slide bed surfaces having substantially the same configuration;

means mounting the first and second slide surfaces above a first supporting surface in side-by-side relationship;

a first wheel chair transfer station adjacent the top of the slide bed surfaces with a second supporting surface for wheelchairs;

a substantially flat horizontally situated entry platform at the top of the slide bed surfaces and elevated above the second supporting surface at the first wheelchair transfer station, said entry platform having an upwardly facing surface that blends into the slide bed surfaces to permit a user to slide along the entry platform onto the slide bed surfaces;

a second wheelchair transfer station adjacent the bottom of the slide bed surfaces having a space for a wheelchair on said first supporting surface;

a substantially flat horizontally situated landing platform at the bottom of the slide bed surfaces and elevated above the first supporting surface, said landing platform having an upwardly facing surface that blends into the slide bed surfaces to permit a user to slide from the bed surfaces onto the upwardly facing surface of the landing platform;

an inclined ramp to permit a user to propel a wheelchair from the first supporting surface to the second wheelchair supporting surface; and means on at least one of the slides and platforms to assist a user in progressively pulling himself back up the second slide, said assist means comprising a plurality of hand holds and means mounting a plurality of the hand holds in spaced relationship above the second slide bed surface.

10. The recreational device for physically disabled persons according to claim 9 wherein the means mounting the hand holds comprises first and second U-bolts, means mounting the first U-bolt to the entry platform in inverted orientation, means mounting the second U-bolt to the landing platform in inverted orientation, a line, means connecting the line to each of the first and second U-bolts and means connecting the hand holds to the line.

11. The recreational device for physically disabled persons according to claim 9 wherein the hand holds are defined by a plurality of fixed upright posts spaced from each other between the top and bottom of the slide bed surfaces.

12. The recreational device for physically disabled persons according to claim 9 wherein said means mounting the hand holds comprises a line with spaced ends, means are provided to connect one end of the line to one of the platforms and means are provided to connect the other end of the line selectively at different heights above the upwardly facing surfaces of the other platform.

13. The recreational device for physically disabled persons according to claim 9 wherein there are first and second spaced flights of stairs adjacent the first and second slides to permit a supervisor to climb alongside of a user on the first and second slides to assist the user thereon.

14. The recreational device for physically disabled persons according to claim 9 wherein there is a bar extending across the first and second slides above the slide bed surfaces adjacent the juncture of the slide bed surfaces and the upwardly facing surface of the entry platform both to assist the user in positioning himself at the top of the first slide and to assist the user in pulling himself up off of the second slide bed surface onto the upwardly facing surface of the entry platform.

15. The recreational device for physically disabled persons according to claim 9 wherein said inclined ramp has at least first and second inclined ramp sections and a substantially flat horizontal rest platform between the first and second ramp sections.

16. The recreational device for physically disabled persons according to claim 9 wherein said assist means comprises first and second spaced lines extending between the top and bottom of the slides and said means mounting the hand holds mount a plurality of the hand holds in spaced relationship on each of the first and second lines.

17. A recreational device for physically disabled persons, said recreational device comprising:

a slide with a low friction inclined bed surface having a top and bottom;

a first wheelchair transfer station adjacent the top of the slide bed surface with a first surface for supporting a wheelchair;

a substantially flat horizontally situated entry platform at the top of the slide bed surface and elevated above the first wheelchair supporting surface at the first wheelchair transfer station, said entry platform having an upwardly facing surface that blends into the slide bed surface to permit a user to slide along the platform onto the slide bed surface;

a second wheelchair transfer station adjacent the bottom of the slide bed surface with a second surface for supporting a wheelchair; and a substantially flat horizontally situated landing platform at the bottom of the bed surface and elevated above the second wheelchair supporting surface, said landing platform having an upwardly facing surface that blends into the slide bed surface to permit a user to slide from the bed surface onto the upwardly facing surface of the landing platform.

18. The recreational device for physically disabled persons according to claim 17 wherein there is a second slide with a top and bottom and an inclined bed having a surface that blends into the upwardly facing surfaces of both the entry and the landing platforms and means are provided to assist a user in progressively pulling himself back up the second slide.

19. The recreational device for physically disabled persons according to claim 17 wherein there is a flight of stairs adjacent to the second slide to permit a supervisor to climb alongside of a user on the second slide to assist the user in pulling himself up the second slide.

20. A recreational device for physically disabled persons, said recreational device comprising:

a slide with a low friction inclined bed surface having a top and bottom;

a substantially flat horizontally situated entry platform at the top of the slide bed surface and elevated above the first wheelchair supporting surface at the first wheelchair transfer station, said entry platform having an upwardly facing surface slide along the platform onto the slide bed surface; and a substantially flat horizontally situated landing platform at the bottom of the bed surface and elevated above the second wheelchair supporting surface, said landing platform having an upwardly facing surface that blends into the slide bed surface to permit a user to slide from the bed surface onto the upwardly facing surface of the landing platform.

* * * * *